US009770150B2

(12) United States Patent
Penner

(10) Patent No.: US 9,770,150 B2
(45) Date of Patent: Sep. 26, 2017

(54) VACUUM CLEANER SIDE BRUSH AND FLOOR CARE DEVICE COMPRISING A VACUUM CLEANER SIDE BRUSH

(71) Applicant: Miele & Cie. KG, Guetersloh (DE)

(72) Inventor: Markus Penner, Lage (DE)

(73) Assignee: MIELE & CIE. KG, Guetersloh (DE)

( * ) Notice: Subject to any disclaimer, the term of this patent is extended or adjusted under 35 U.S.C. 154(b) by 36 days.

(21) Appl. No.: 14/938,935

(22) Filed: Nov. 12, 2015

(65) Prior Publication Data

US 2016/0143496 A1 May 26, 2016

(30) Foreign Application Priority Data

Nov. 20, 2014 (DE) ..... 10 2014 116 989

(51) Int. Cl.

| | |
|---|---|
| ***A46B 7/10*** | (2006.01) |
| ***A47L 9/04*** | (2006.01) |
| ***A47L 11/40*** | (2006.01) |

(52) U.S. Cl.

CPC ..... *A47L 9/04* (2013.01); *A47L 9/0472* (2013.01); *A47L 11/4038* (2013.01); *A47L 11/4069* (2013.01); *A46B 7/10* (2013.01); *A47L 2201/00* (2013.01)

(58) Field of Classification Search

CPC .. A47L 13/008; A47L 11/4038; A47L 9/0472; A46B 7/06; A46B 7/08; A46B 7/10
USPC ..... 15/42, 179, 180, DIG. 5
IPC ..... A46B 7/10
See application file for complete search history.

(56) References Cited

U.S. PATENT DOCUMENTS

| | | | | |
|---|---|---|---|---|
| 4,153,967 | A * | 5/1979 | Thoma | A46B 9/06 15/181 |
| 6,145,913 | A * | 11/2000 | Odagaki | B60N 2/01583 296/65.03 |
| 2004/0148731 | A1 | 8/2004 | Damman et al. | |
| 2012/0110775 | A1 | 5/2012 | Krebs | |
| 2013/0263889 | A1 | 10/2013 | Yoon et al. | |
| 2014/0189977 | A1 | 7/2014 | Wang et al. | |

FOREIGN PATENT DOCUMENTS

| | | |
|---|---|---|
| EP | 2561785 A2 | 2/2013 |

* cited by examiner

*Primary Examiner* — David Redding
(74) *Attorney, Agent, or Firm* — Leydig, Voit & Mayer, Ltd.

(57) ABSTRACT

A side brush for a vacuum cleaner includes a brush core and at least ten bristle clusters regularly distributed over a circumferential surface of the brush core.

7 Claims, 3 Drawing Sheets

VACUUM CLEANER SIDE BRUSH AND FLOOR CARE DEVICE COMPRISING A VACUUM CLEANER SIDE BRUSH

CROSS-REFERENCE TO PRIOR APPLICATION

Priority is claimed to German Patent Application No. DE 10 2014 116 989.1, filed on Nov. 20, 2014, the entire disclosure of which is hereby incorporated by reference herein.

FIELD

The invention relates to a side brush for a vacuum cleaner (vacuum cleaner side brush) or for another floor care device, in particular a side brush for an autonomous, self-propelled vacuum cleaner system (robotic vacuum cleaner).

BACKGROUND

Floor care devices, such as floor-type vacuum cleaners, upright vacuum cleaners or robotic vacuum cleaners, have certain shapes in a region in contact with the surface to be cleaned in order to gather and transport the usually solid dust and dirt particles using certain physical principles. An important principle is the pulsed solid contact between the brush filaments and the floor being worked on in each case, as well as the dirt particles found thereon. In this way, said dirt particles are mobilised and transported.

In order to increase the surface-cleaning capacity, it is of particular importance, especially also in robotic vacuum cleaners, for the regions to the right and left of the suction mouth itself to be worked on by assistive side brushes. An essential aim of such side brushes and the brush clusters is to solely mechanically move dirt particles found on the floor using the brush filaments of the brush clusters and to deliver them to the suction mouth.

Such side brushes are known, for example from EP 2 606 798 A2. Known side brushes comprise just a few regularly spaced brush arms in the form of paintbrush-like brushes, that is to say bristle clusters or sleeves having bristle clusters fastened therein. The known side brushes comprise two, three, four or five brush arms of this type, and in any case comprise few brush arms.

The drawback of such side brushes primarily consists in the unsatisfactory surface coverage. This results from the fact that, for example in a robotic vacuum cleaner, the speed when moving over a portion of floor to be worked on in each case is so high relative to the rotational speed of the side brushes that the areas brushed by the individual bristle clusters are several millimeters to several centimeters apart. This leads to dirt, such as individual crumbs or the like, not being gathered by the side brushes and remaining on the surface to be cleaned.

SUMMARY

A side brush for a vacuum cleaner includes a brush core and at least ten bristle clusters regularly distributed over a circumferential surface of the brush core.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
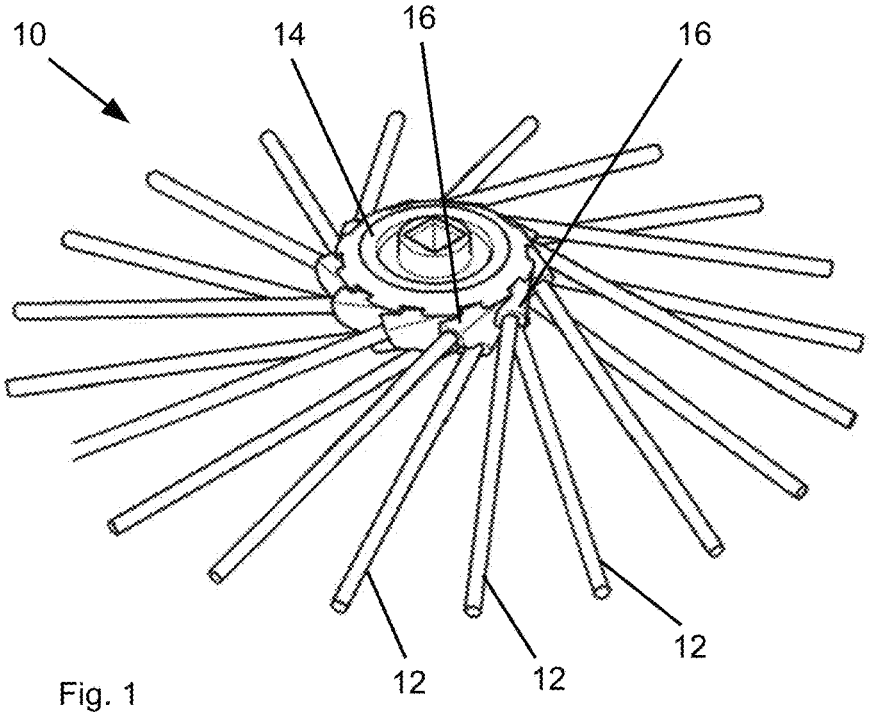
FIG. 1 is an isometric view of a side brush for a floor care device, for example a vacuum cleaner or robotic vacuum cleaner.

In an embodiment, the present invention provides another embodiment of a side brush, in particular a side brush having improved surface coverage, and a floor care device, in particular a floor care device in the form of a robotic vacuum cleaner, comprising at least one such side brush.

In a side brush for a floor care device, in particular a vacuum cleaner or a vacuum cleaner in the form of a robotic vacuum cleaner, the following are provided: the side brush comprises a brush core and bristle clusters that are regularly distributed over a circumferential surface of the brush core and has a quantity of bristle clusters that is higher in comparison with previous side brushes, that is to say at least ten bristle clusters, for example. A floor care device that is proposed here, that is to say for example a floor care device in the form of a vacuum cleaner or robotic vacuum cleaner, is characterised in that said floor care device comprises at least one such side brush in a position that is standard for a side brush, or comprises a side brush of this type in respective positions that are standard for a side brush, that is to say at least two side brushes.

The higher quantity of bristle clusters, that is to say at least ten bristle clusters, for example twenty bristle clusters, results in the improved surface coverage that is sought, because each end of a bristle cluster brushes the floor that is being worked on in each case and accordingly, by means of the higher quantity of bristle clusters proposed here, the areas brushed by the individual bristle clusters that result when a vacuum cleaner passes over a floor that is being worked on in each case are closer to one another than can be the case for previous side brushes having the conventional three, four or at the most five bristle clusters. Owing to the higher quantity of bristle clusters, the rotational speed of the side brushes can furthermore be reduced without the surface coverage and the cleaning result being impaired. A reduced rotational speed advantageously leads to reduced noise development and to reduced wear.

In one embodiment of the side brushes, the bristle clusters are arranged in at least two parallel planes (insertion planes) on the brush core, a plurality of bristle clusters being positioned in each insertion plane, in particular such that the same quantity of bristle clusters or at least substantially the same quantity of bristle clusters are positioned in each insertion plane. The use of a plurality of parallel insertion planes, that is to say at least two parallel insertion planes, makes possible, in a particularly advantageous manner, the increase in the quantity of bristle clusters that is sought in order to improve the surface coverage, without this affecting the stability of the brush core or making it necessary to design said core to be disadvantageously large in order to increase the stability.

In another embodiment of the side brushes, the bristle clusters are arranged and oriented on the brush core such that the tips of all the bristle clusters of each of the at least two planes lie on a common enveloping circular line or at least substantially on a common enveloping circular line. When the tips of the bristle clusters lie on a common enveloping circular line or substantially on a common enveloping circular line, all the tips brush the same point when the floor care device is stationary. When the floor care device is moving, the resulting brushed areas over the floor that is being worked on in each case are particularly close to one another, so that optimum surface coverage results.

Yet another embodiment of the side brush is distinguished by an alternating arrangement of the bristle clusters in the at least two insertion planes. Here, the alternating arrangement refers to the sequence of the ends of the bristle clusters over the common enveloping circular line. A bristle cluster belonging to any end of a bristle cluster (first cluster) located there is followed in the rotational direction by the end of a bristle cluster (second cluster) that is fastened to the brush core in an insertion plane that is different compared with the first cluster. The end of the second cluster is followed by the end of a further bristle cluster (third cluster), the bristle cluster of which is fastened to the brush core in an insertion plane that is different compared with the insertion plane of the second cluster, for example in the insertion plane of the first cluster. This alternating arrangement allows the ends of the bristle clusters to be regularly distributed over the common enveloping circular line and thus also ensures optimum surface coverage.

In a particular embodiment of the side brush, the bristle clusters are each fastened to the brush core in a sleeve or a hole (referred to in the following as a sleeve), each sleeve being oriented approximately tangentially to the circumferential surface of the brush core. This tangential orientation of each sleeve results in each brush cluster likewise being oriented tangentially or at least substantially tangentially to the circumferential surface of the brush core. A bristle cluster which runs perpendicularly into an obstacle may disadvantageously influence the manoeuvrability of a floor care device comprising such a bristle cluster. For bristle clusters oriented approximately tangentially to the circumferential surface of the brush core, the end of a bristle cluster of the side brush that is the furthest forward in the movement direction never runs perpendicularly into a potential obstacle, and therefore the disadvantageous influence on manoeuvrability that is otherwise possible does not occur. When the bristle cluster having the end that is furthest forward comes into contact with an obstacle, it is deflected into the approximate tangential orientation that is already present to a greater extent, and this presents a negligibly small amount of resistance for the forward movement of the floor care device in any case. Another advantage of the approximately tangentially oriented sleeves consists, in comparison with radially oriented sleeves, for example, in the proportion of the insertion depth of the individual bristle clusters inside each sleeve being lower when measured in the radial direction. In approximately tangentially oriented sleeves, each portion of a bristle cluster that is fastened therein may be positioned at an insertion depth in the sleeve that goes beyond the radius of the brush core. Comparably secure fastening of the bristle cluster in a radially oriented sleeve can only be achieved by a significantly larger brush core, namely a brush core having a greater diameter. The approximately tangential orientation of the sleeves thus also prevents the brush core from having to be designed to be unnecessarily large.

An embodiment of the invention is shown in a purely schematic manner in the drawings and will be described in greater detail below. Subjects or elements corresponding to one another are provided with the same reference numerals in all the drawings. The embodiment should not be understood as a restriction of the invention. Instead, amendments and modifications are also possible within the scope of the present disclosure, in particular those of the type which can be inferred by a person skilled in the art with regard to solving the problem by, for example, combining or amending individual features and elements or method steps in conjunction with all those described in the general or specific part of the description and contained in the claims and/or the drawings, and which lead to new subject matter or new method steps by way of combinable features.

FIG. 1 shows an embodiment of a side brush 10 proposed here for a floor care device, for example a floor care device in the form of a vacuum cleaner, in particular in the form of a robotic vacuum cleaner. The side brush 10 comprises a plurality of bristle clusters 12, in the embodiment shown it comprises exactly twenty bristle clusters 12. The brush filaments included by the bristle clusters 12 are not shown separately and the cylindrical shape shown is intended to represent the entirety of the respective brush filaments.

All the bristle clusters 12 are fastened to a brush core 14 (main body of the brush) of the side brush 10, and the brush core 14 defines a rotational axis of the side brush 10 and for this purpose, in the embodiment shown, comprises a recess/hole for positively receiving a rotational axis or the like that is driven in the usual manner.

Each bristle cluster 12—or a brush arm comprising a bristle cluster at the free end instead of the bristle cluster 12 shown—is fastened to the brush core 14 in a sleeve or hole (referred to here and in the following as a sleeve 16) in each case. A hole for receiving a portion of a bristle cluster 12 is made in the solid material of the brush core 14. A sleeve 16 may be integrally formed on the brush core 14, in particular may be formed in one piece with the brush core 14 or may be bonded to the brush core 14 or connected thereto in another suitable manner.

Figure 2:
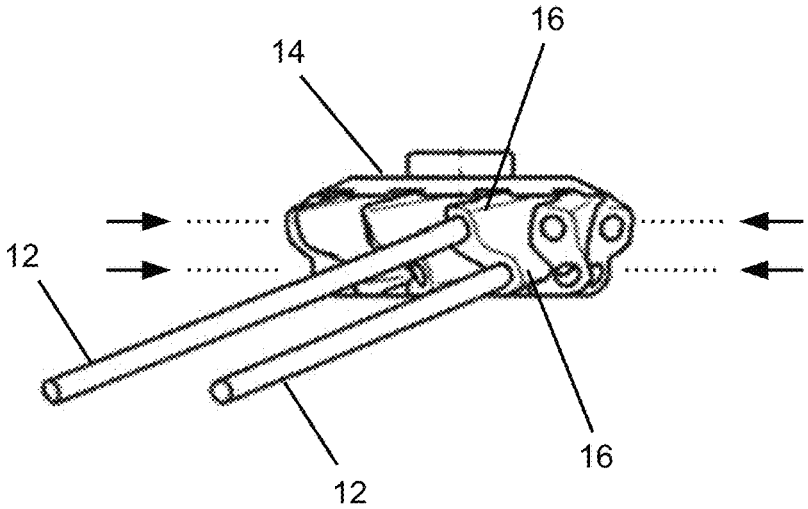
FIG. 2 shows a part of a side brush according to FIG. 1.

FIG. 2 is a side view of a part of a side brush 10 according to FIG. 1. It shows two sleeves 16, which are in pairs and positioned in different insertion planes indicated by horizontal arrows at the sides, and the bristle clusters 12 that are fastened therein.

Figure 3:
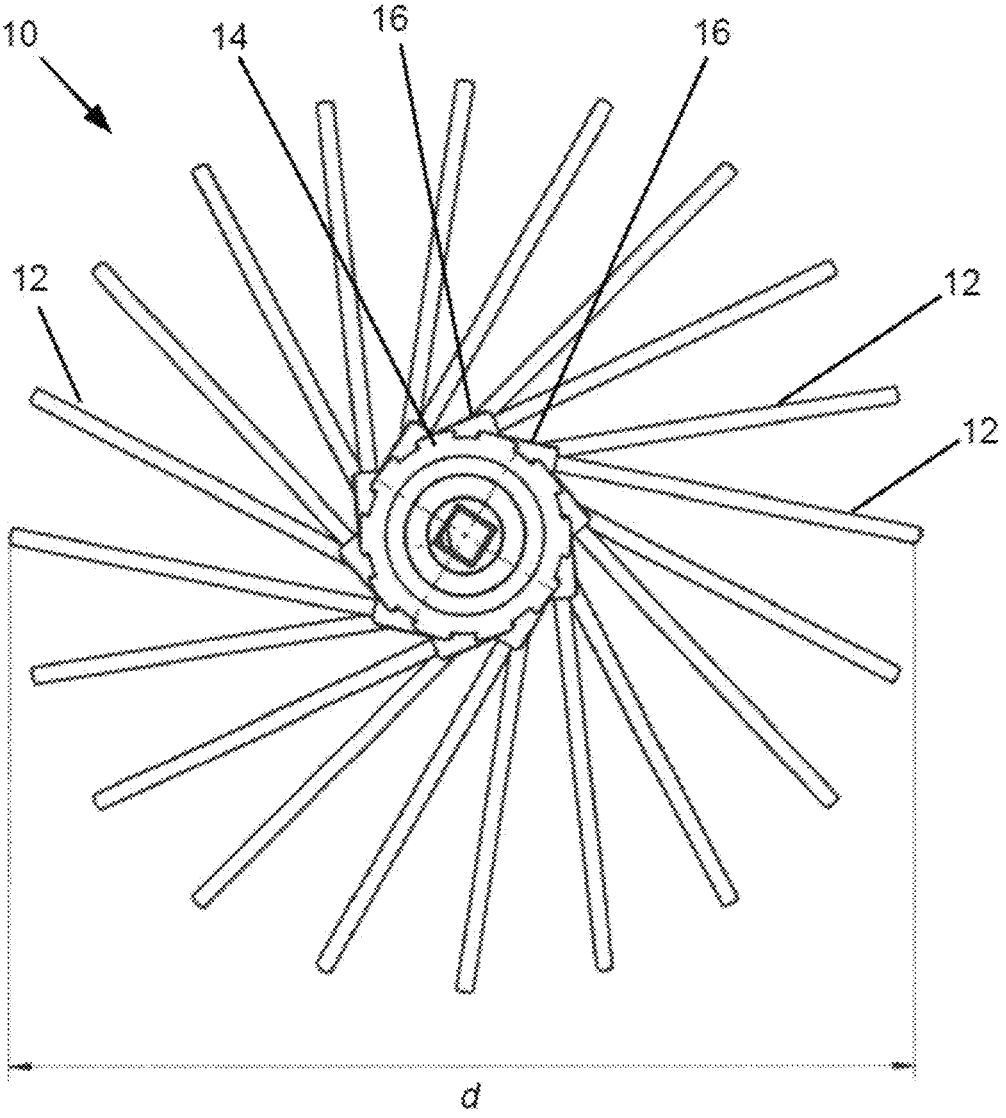
FIG. 3 is a plan view of the side brush according to FIG. 1.

FIG. 3 is a plan view of the side brush 10 according to FIG. 1. Primarily, it shows particularly well that the ends of all the bristle clusters 12 lie on a common enveloping circular line 20 (FIG. 4) or at least substantially lie on a common enveloping circular line 20, and specifically irrespective of the insertion plane in which the bristle clusters 12 are fastened to the brush core 14. Furthermore, the alternating arrangement of the bristle clusters 12 in the insertion planes that is described at the outset and is based on the sequence of the ends of the bristle clusters 12 over the enveloping circular line 20 can also be seen.

Figure 4:
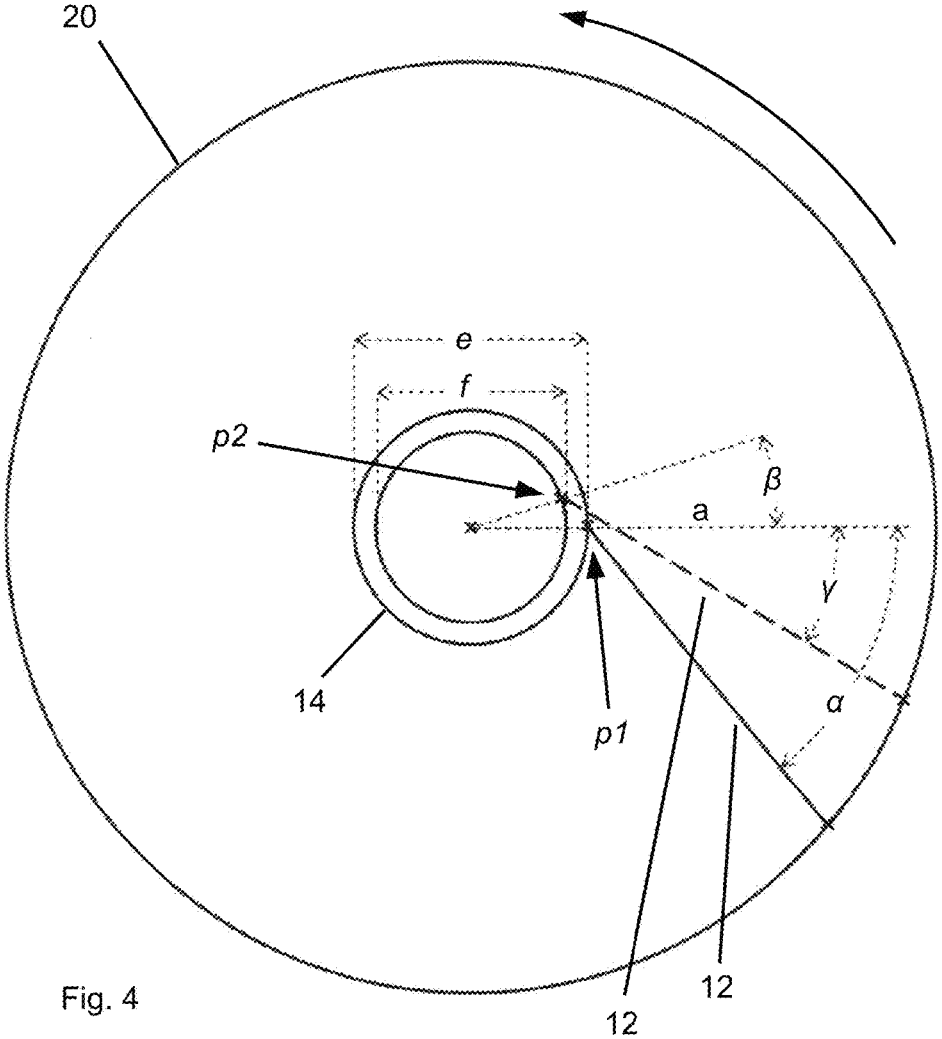
FIG. 4 and FIG. 5 are two views intended to illustrate geometric ratios of the side brush.
Figure 5:
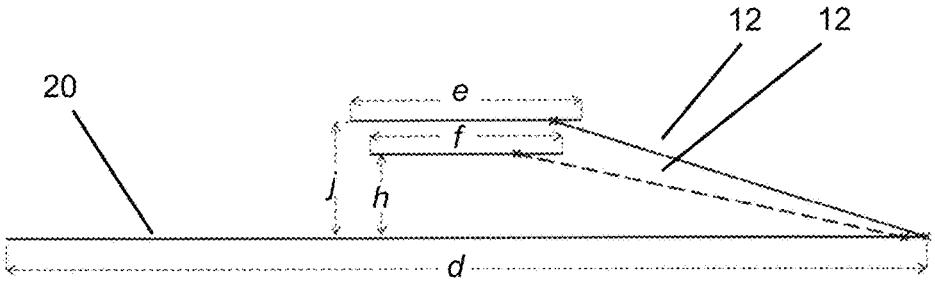

The enveloping circular line 20 is shown separately in FIG. 4. FIG. 4 and FIG. 5 illustrate separate geometric ratios of the side brush 10 that are described in the following. The diameter of the enveloping circle defined by the enveloping circular line 20 is denoted by d (FIGS. 3 and 5) and is for example 120 mm, diameters in the range of from approximately 100 mm to 140/150 mm resulting for other preferred dimensions of the side brush 10. A first and a second diameter of the brush core 14 are denoted in FIGS. 4 and 5 by e and f. The first, greater diameter e results in the region of the upper insertion plane of the brush core 14 and the second diameter accordingly results in the region of the lower insertion plane. In the embodiment shown, the first diameter e is 30 mm (±10 mm) and the second diameter f is 25 mm (±10 mm). In the embodiment shown, the lower and the upper insertion planes on the brush core 14 are approximately 11 mm (h) and approximately 15 mm (j) respectively over the enveloping circle that is common to all the bristle-cluster ends (FIG. 5).

Depending on the insertion plane, a different angle results between the individual bristle clusters 12 fastened therein and the horizontal. FIG. 5 shows this in a schematically simplified manner, the lines (a solid line and a dashed line) that start from the insertion planes and stretch to the right-hand edge of the enveloping circular line 20 each representing a bristle cluster 12.

FIG. 4 also shows individual angles that result in a plan view of the side brush 10. At an insertion point p1 that lies on the central axis a of the enveloping circle, an angle $\alpha$ between the central axis a and the bristle cluster 12 starting from the insertion point p1 is approximately 50° (±10°), and in the embodiment shown is 51°. The angular distance between a first insertion point p1 and an additional insertion point p2 is approximately $\beta$=18°. Here, the two insertion points p1 and p2 shown are the starting points of those bristle clusters 12 that belong to two bristle-cluster ends that are in immediate succession over the enveloping circular line 20. Lastly, FIG. 4 also shows an angle $\gamma$ which is 31° in the embodiment shown and represents the angle between the central axis a and the bristle cluster 12 which is advancing in the rotational direction (shown by the directional arrow in the top right) of the side brush 10.

By means of the approach proposed here and a corresponding side brush 10 or two such side brushes 10, owing to improved surface coverage a clear advantage results in terms of subjectively perceived and measurable cleaning performance when compared with previous side brushes and a robotic vacuum cleaner equipped therewith.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

10 side brush
12 bristle cluster
14 brush core
16 sleeve (on/in the brush core and for receiving a bristle cluster)
18 (free)
20 enveloping circular line

What is claimed is:

1. A side brush for a vacuum cleaner, the side brush comprising:
- a brush core; and
- at least ten bristle clusters regularly distributed over a circumferential surface of the brush core,
- wherein the bristle clusters are arranged in at least two parallel planes on the brush core and wherein a respective plurality of the bristle clusters are positioned in each plane, and
- wherein tips of all the bristle clusters of each of the at least two planes lie substantially on a common enveloping circular line.

2. The side brush of claim 1, further comprising an alternating arrangement of the bristle clusters in the at least two planes.

3. The side brush of claim 1, wherein the bristle clusters are each fastened in a respective sleeve, and wherein each of the sleeves is oriented approximately tangentially to the circumferential surface of the brush core.

4. A floor care device comprising at least one side brush as claimed in claim 1.

5. The floor care device of claim 4, wherein the floor care device comprises a robotic vacuum cleaner.

6. The side brush of claim 1, wherein the at least two parallel planes comprise an upper insertion plane at a first height over the common enveloping circular line and a lower insertion plane at a second height over the common enveloping circular line.

7. The side brush of claim 6, wherein the first height is greater than the second height.

* * * * *